US006633645B2

(12) United States Patent
Bren et al.

(10) Patent No.: US 6,633,645 B2
(45) Date of Patent: Oct. 14, 2003

(54) AUTOMATIC TELEPHONE SWITCH FOR HEARING AID

(75) Inventors: Mark A. Bren, Lorretto, MN (US); Timothy S. Peterson, Lino Lakes, MN (US)

(73) Assignee: Micro Ear Technology, Inc., Plymouth, MN (US)

( * ) Notice: Subject to any disclaimer, the term of this patent is extended or adjusted under 35 U.S.C. 154(b) by 0 days.

(21) Appl. No.: 10/214,045

(22) Filed: Aug. 7, 2002

(65) Prior Publication Data

US 2002/0186857 A1 Dec. 12, 2002

Related U.S. Application Data

(63) Continuation of application No. 09/659,214, filed on Sep. 11, 2000.

(51) Int. Cl.[7] ..... H04R 25/00

(52) U.S. Cl. ..... 381/1; 381/331; 381/312; 361/160

(58) Field of Search ..... 381/312, 320, 381/321, 328–330, 331, 314–315, 323; 379/52, 430, 443, 444; 361/152, 182, 184, 160; 455/116, 66

(56) References Cited

U.S. PATENT DOCUMENTS

| | | | | |
|---|---|---|---|---|
| 2,530,621 A | | 11/1950 | Lybarger | 179/107 |
| 2,554,834 A | | 5/1951 | Lavery | 179/107 |
| 2,656,421 A | | 10/1953 | Lybarger | 179/107 |
| 3,396,245 A | * | 8/1968 | Flygstad | 381/331 |
| 4,187,413 A | | 2/1980 | Moser | 179/107 |
| 4,467,145 A | * | 8/1984 | Borstel | 381/329 |
| 4,489,330 A | * | 12/1984 | Marutake et al. | 343/742 |
| 4,490,585 A | * | 12/1984 | Tanaka | 379/52 |
| 4,508,940 A | | 4/1985 | Steeger | 179/107 |

(List continued on next page.)

FOREIGN PATENT DOCUMENTS

| | | | |
|---|---|---|---|
| DE | 3036417 | 5/1982 | H04R/25/00 |
| DE | 3443907 | 6/1985 | |
| FR | 2714561 | 6/1995 | |
| JP | 09-018998 | 1/1997 | H04R/25/02 |

OTHER PUBLICATIONS

Beck, L..B. , "The "T" Switch; Some Tips for Effective Use", *Shhh,* (Jan./Feb. 1989),pp. 12–15.

Gilmore, R.., "Telecoils: past, present & future", *Hearing Instruments,* 44 (2), (1993),pp. 22, 26–27, 40.

Lybarger, S..F. ,"Development of a New Hearing Aid with Magnetic Microphone", *Electrical Manufacturing,* (Nov., 1947), 11 pages.

Preves, D..A. ,"A Look at the Telecoil—It's Development and Potential", *SHHH Journal,* (Sep./Oct. 1994),pp. 7–10.

Hansaton Akustik GMBH, "48 K–AMP Contactmatic", (*from Service Manual*), (Apr. 1996),8 pgs.

Schaefer, Conrad, "Letter referencing Micro Ear Patent", (Jul. 22, 2002),2 pgs.

*Primary Examiner*—Sinh Tran
*Assistant Examiner*—P. Dabney
(74) *Attorney, Agent, or Firm*—Schwegman, Lundberg, Woessner & Kluth, P.A.

(57) ABSTRACT

A hearing aid is provided with a switch that automatically switches the hearing aid input from a microphone input to a voice coil input in the presence of a magnetic field. The magnetic field can be generated by a magnet in a telephone handset.

14 Claims, 2 Drawing Sheets

U.S. PATENT DOCUMENTS 4,596,899 A 6/1986 Wojcik et al.
4,631,419 A * 12/1986 Sadamatsu et al. ..... 327/485
4,638,125 A 1/1987 Buettner ..... 381/68.4
4,696,032 A 9/1987 Levy ..... 379/390
4,710,961 A 12/1987 Buttner ..... 381/68.7
4,764,957 A * 8/1988 Angelini et al. ..... 379/433.06
4,845,755 A * 7/1989 Busch et al. ..... 381/315
4,862,509 A * 8/1989 Towsend ..... 381/163
4,887,299 A 12/1989 Cummins et al. ..... 381/68.4
4,926,464 A * 5/1990 Schley-May ..... 379/93.37
4,930,156 A * 5/1990 Norris ..... 379/388.02
5,010,575 A 4/1991 Marutake et al. ..... 381/68
5,027,410 A 6/1991 Williamson et al.
5,086,464 A 2/1992 Groppe ..... 379/430
5,091,952 A 2/1992 Williamson et al.
5,189,704 A 2/1993 Krauss ..... 381/68.4
5,212,827 A * 5/1993 Meszko et al. ..... 455/225
5,280,524 A * 1/1994 Norris ..... 379/388.02
5,404,407 A 4/1995 Weiss ..... 381/68
5,422,628 A 6/1995 Rodgers ..... 340/573
5,425,104 A * 6/1995 Shennib ..... 381/326
5,463,692 A 10/1995 Fackler ..... 381/68
5,524,056 A * 6/1996 Killion et al. ..... 381/68.2
5,553,152 A 9/1996 Newton ..... 381/68.6
5,636,285 A * 6/1997 Sauer ..... 381/314
5,640,293 A 6/1997 Dawes et al. ..... 361/93
5,640,457 A 6/1997 Gnecco et al.
5,659,621 A * 8/1997 Newton ..... 381/312
5,687,242 A 11/1997 Iburg
5,706,351 A 1/1998 Weinfurtner ..... 381/68.2
5,710,820 A 1/1998 Martin et al. ..... 381/68.4
5,737,430 A 4/1998 Widrow
5,740,257 A 4/1998 Marcus
5,751,820 A * 5/1998 Taenzer ..... 381/312
5,757,933 A 5/1998 Preves et al. ..... 381/68
5,768,397 A 6/1998 Fazio ..... 381/68
5,796,848 A 8/1998 Martin ..... 381/68.2
5,809,151 A 9/1998 Husung ..... 381/69
5,823,610 A * 10/1998 Ryan et al. ..... 296/180.4
5,991,420 A 11/1999 Stern ..... 381/315
6,031,922 A 2/2000 Tibbetts
6,031,923 A 2/2000 Gnecco et al.
6,078,675 A * 6/2000 Bowen-Nielsen et al. .. 381/331
6,101,258 A 8/2000 Killion et al.
6,104,821 A 8/2000 Husung ..... 381/312
6,115,478 A * 9/2000 Schneider ..... 381/314
6,118,877 A * 9/2000 Lindemann et al. ..... 381/60
6,148,087 A 11/2000 Martin ..... 381/327
6,157,727 A * 12/2000 Rueda ..... 381/312
6,157,728 A 12/2000 Tong et al.
6,310,556 B1 10/2001 Green et al. ..... 340/636
6,324,291 B1 11/2001 Weidner ..... 381/322
6,327,370 B1 12/2001 Killion et al.
6,356,741 B1 * 3/2002 Bilotti et al. ..... 455/90
6,381,308 B1 * 4/2002 Cargo et al. ..... 379/52
6,459,882 B1 * 10/2002 Palermo et al. ..... 455/41
6,466,679 B1 * 10/2002 Husung ..... 381/324

* cited by examiner

AUTOMATIC TELEPHONE SWITCH FOR HEARING AID

CROSS-REFERENCE TO RELATED APPLICATION(S)

This application is a continuation of U.S. patent application Ser. No. 09/659,214, filed on Sep. 11, 2000, the specification of which is hereby incorporated by reference.

FIELD OF THE INVENTION

This invention relates generally to hearing aids, and more particularly to an automatic switch for a hearing aid.

BACKGROUND

Hearing aids can provide adjustable operational modes or characteristics that improve the performance of the hearing aid for a specific person or in a specific environment. Some of the operational characteristics are volume control, tone control, and selective signal input. One way to control these characteristics is by a manually engagable switch on the hearing aid. As discussed in U.S. Pat. No. 5,757,933, it may be desirable to have both a non-directional microphone and a directional microphone in a single hearing aid. Thus, when a person is talking to someone in a crowded room the hearing aid can be switched to the directional microphone in an attempt to directionally focus the reception of the hearing aid and prevent amplification of unwanted sounds from the surrounding environment. However, the switch on the hearing aid in the '933 patent is a switch that must be operated by hand. It can be a drawback to require manual or mechanical operation of a switch to change the input or operational characteristics of a hearing aid. Moreover, manually engaging a switch in a hearing aid that is mounted within the ear canal is difficult, and may be impossible, for people with impaired finger dexterity.

In some known hearing aids, magnetically activated switches are controlled through the use of magnetic actuators, for examples see U.S. Pat. Nos. 5,553,152 and 5,659,621. The magnetic actuator is held adjacent the hearing aid and the magnetic switch changes the volume. However, such a hearing aid requires that a person have the magnetic actuator available when it desired to change the volume. Consequently, a person must carry an additional piece of equipment to control his\her hearing aid. Moreover, there are instances where a person may not have the magnetic actuator immediately present, for example when in the yard or around the house.

Once the actuator is located and placed adjacent the hearing aid, this type of circuitry for changing the volume must cycle through the volume to arrive at the desired setting. Such an action takes time and adequate time may not be available to cycle through the settings to arrive at the required setting, for example there may be insufficient time to arrive at the required volume when answering a telephone.

Some hearing aids have an input which receives the electromagnetic voice signal directly from the voice coil of a telephone instead of receiving the acoustic signal emanating from the telephone speaker. Accordingly, signal conversion steps, namely, from electromagnetic to acoustic and acoustic back to electromagnetic, are removed and a higher quality voice signal reproduction may be transmitted to the person wearing the hearing aid. It may be desirable to quickly switch the hearing aid from a microphone (acoustic) input to a coil (electromagnetic field) input when answering and talking on a telephone. However, quickly manually switching the input of the hearing aid from a microphone to a voice coil may be difficult for some hearing aid wearers.

SUMMARY OF THE INVENTION

Upon reading and understanding the present disclosure it is recognized that the inventive subject matter described herein satisfies the foregoing needs in the art and several other needs in the art not expressly noted herein. The following summary is provided to give the reader a brief summary which is not intended to be exhaustive or limiting and the scope of the invention is provided by the attached claims and the equivalents thereof.

One embodiment of the present invention provides a method and apparatus for switching of a hearing aid input between an acoustic input and an electromagnetic field input. In one embodiment a method and an apparatus are provided for automatically switching from acoustic input to electromagnetic field input in the presence of the telephone handset.

BRIEF DESCRIPTION OF THE DRAWINGS

A more complete understanding of the invention and its various features, objects and advantages may be obtained from a consideration of the following detailed description, the appended claims, and the attached drawings in which:

DETAILED DESCRIPTION

In the following detailed description, reference is made to the accompanying drawings which form a part hereof and in which is shown by way of illustration a specific embodiment in which the invention can be practiced. This embodiment is described in sufficient detail to enable those skilled in the art to practice and use the invention, and it is to be understood that other embodiments may be utilized and that electrical, logical, and structural changes may be made without departing from the spirit and scope of the present invention. The following detailed description is, therefore, not to be taken in a limiting sense and the scope of the present invention is defined by the appended claims and their equivalents.

Figure 1:
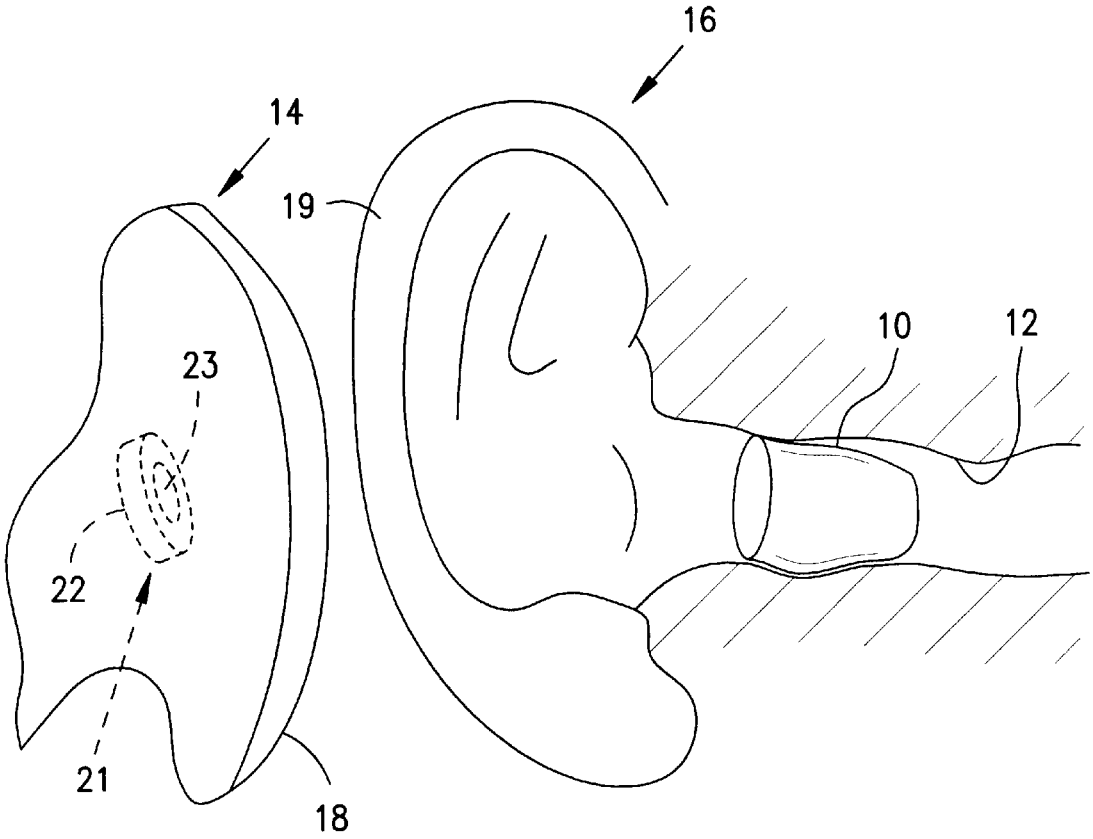
FIG. 1 illustrates the hearing aid of the present invention adjacent a telephone handset.
Figure 2:
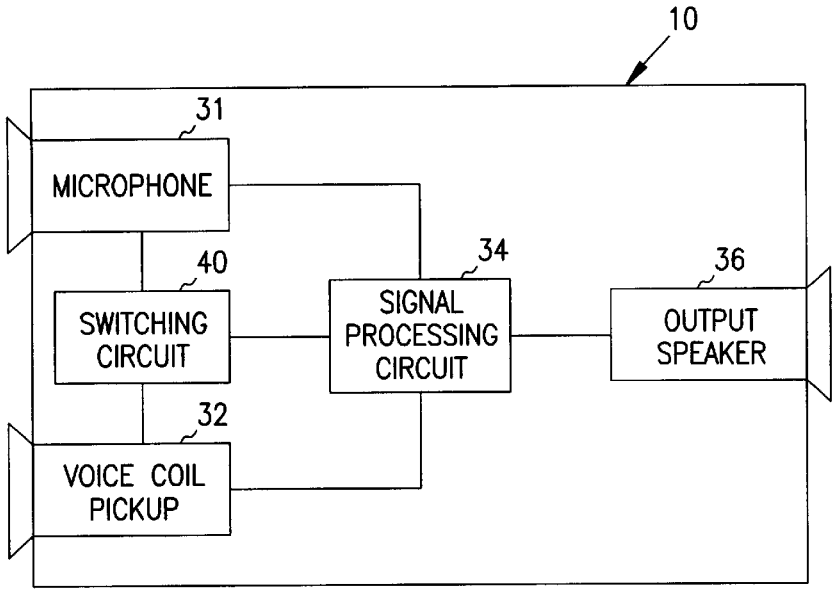
FIG. 2 is a schematic view of the FIG. 1 hearing aid.

FIG. 1 illustrates an in-the-ear hearing aid 10 which is shown positioned completely in the ear canal 12. A telephone handset 14 is positioned adjacent the ear 16 and, more particularly, the speaker 18 of the handset is adjacent the pinna 19 of ear 16. Speaker 18 includes an electromagnetic transducer 21 which includes a permanent magnet 22 and a voice coil 23 fixed to a speaker cone (not shown). Briefly, the voice coil 23 receives the time-varying component of the electrical voice signal and moves relative to the stationary magnet 22. The speaker cone moves with coil 23 and creates an audio pressure wave ("acoustic signal"). It has been found that when a person wearing a hearing aid uses a telephone it more efficient for the hearing aid 10 to pick up the voice signal from the magnetic field gradient produced by the voice coil 23 and not the acoustic signal produced by the speaker cone.

Hearing aid 10 has two inputs, a microphone 31 and a voice coil pickup 32. The microphone 31 receives acoustic signals, converts them into electrical signals and transmits same to a signal processing circuit 34. The signal processing circuit 34 provides various signal processing functions which can include noise reduction, amplification, and tone control. The signal processing circuit 31 outputs an electrical signal to an output speaker 36 which transmits audio into the wearer's ear. The voice coil pickup 32 is an electromagnetic transducer which senses the magnetic field gradient produced by movement of the telephone voice coil 23 and in turn produces a corresponding electrical signal which is transmitted to the signal processing circuit 34. Accordingly, use of the voice coil pickup 32 eliminates two of the signal conversions normally necessary when a conventional hearing aid is used with a telephone, namely, the telephone handset 14 producing an acoustic signal and the hearing aid microphone 31 converting the acoustic signal to an electrical signal. It is believed that the elimination of these signal conversions improves the sound quality that a user will hear from the hearing aid.

A switching circuit 40 is provided to switch the hearing aid input from the microphone 31, the default state, to the voice coil pickup 32, the magnetic field sensing state. It is desired to automatically switch the states of the hearing aid 10 when the telephone handset 14 is adjacent the hearing aid wearer's ear. Thereby, the need for the wearer to manually switch the input state of the hearing aid when answering a telephone call and after the call is eliminated. Finding and changing the state of the switch on a miniaturized hearing aid can be difficult especially when under the time constraints of a ringing telephone.

Figure 3:
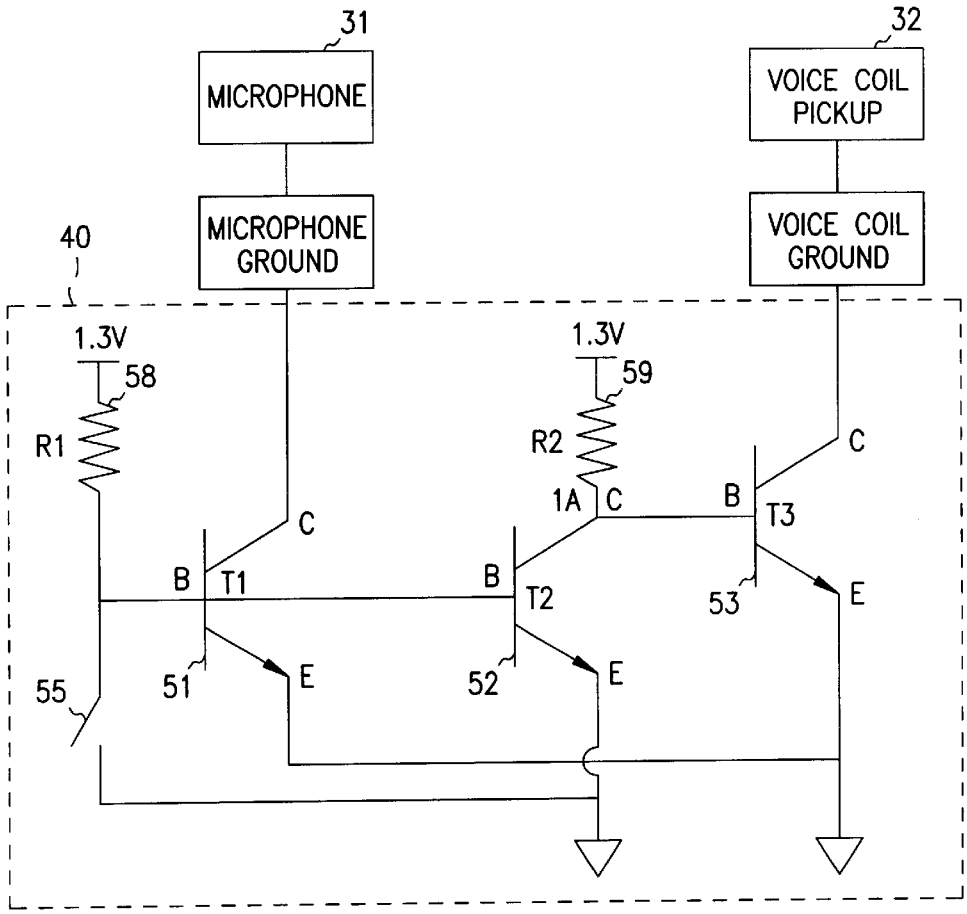
FIG. 3 shows a diagram of the switching circuit of FIG. 2.

The switching circuit 40 of the described embodiment changes state when in the presence of the telephone handset magnet 22 which produces a constant magnetic field that switches the hearing aid input from the microphone 31 to the voice coil pickup 32. As shown in FIG. 3, the switching circuit 40 includes a microphone activating first switch 51, here shown as a transistor that has its collector connected to the microphone ground, base connected to a hearing aid voltage source through a resistor 58, and emitter connected to ground. Thus, the default state of hearing aid 10 is switch 58 being on and the microphone circuit being complete. A second switch 52 is also shown as a transistor that has its collector connected to the hearing aid voltage source through a resistor 59, base connected to the hearing aid voltage source through resistor 58, and emitter connected to ground. A voice coil activating third switch 53 is also shown as a transistor that has its collector connected to the voice pick up ground, base connected to the collector of switch 52 and through resistor 59 to the hearing aid voltage source, and emitter connected to ground. A magnetically activated fourth switch 55 has one contact connected to the base of first switch 51 and through resistor 58 to the hearing aid voltage source, and the other contact is connected to ground. Contacts of switch 55 are normally open.

In this default open state of switch 55, switches 51 and 52 are conducting. Therefore, switch 51 completes the circuit connecting microphone 31 to the signal processing circuit 34. Switch 52 connects resistor 59 to ground and draws the voltage away from the base of switch 53 so that switch 53 is open and not conducting. Accordingly, hearing aid 10 is operating with microphone 31 active and the voice coil pickup 32 inactive.

Switch 55 is closed in the presence of a magnetic field, particularly in the presence of the magnetic field produced by telephone handset magnet 22. In one embodiment of the invention, switch 55 is a reed switch, for example a micro-miniature reed switch, type HSR-003 manufactured by Hermetic Switch, Inc. of Chickasha, Okla. When the telephone handset magnet 22 is close enough to the hearing aid wearer's ear, the magnetic field produced by magnet 22 closes switch 55. Consequently, the base of switch 51 and the base of switch 52 are now grounded. Switches 51 and 52 stop conducting and microphone ground is no longer grounded. That is, the microphone circuit is open. Now switch 52 no longer draws the current away from the base of switch 53 and same is energized by the hearing aid voltage source through resistor 59. Switch 53 is now conducting. Switch 53 connects the voice pickup coil ground to ground and completes the circuit including the voice coil pickup 32 and signal processing circuit 34.

In usual operation, switch 55 automatically closes and conducts when it is in the presence of the magnetic field produced by telephone handset magnet 22. This eliminates the need for the hearing aid wearer to find the switch, manually change switch state, and then answer the telephone. The wearer can conveniently merely pickup the telephone handset and place it by his\her ear whereby hearing aid 10 automatically switches from receiving microphone (acoustic) input to receiving pickup coil (electromagnetic) input. Additionally, hearing aid 10 automatically switches back to microphone input after the telephone handset 14 is removed from the ear. This is not only advantageous when the telephone conversation is complete but also when the wearer needs to talk with someone present (microphone input) and then return to talk with the person on the phone (voice coil input).

While the disclosed embodiment references an in-the-ear hearing aid, it will be recognized that the inventive features of the present invention are adaptable to other styles of hearing aids including over-the-ear, behind-the-ear, eye glass mount, implants, body worn aids, etc. Due to the miniaturization of hearing aids, the present invention is advantageous to many miniaturized hearing aids.

Possible applications of the technology include, but are not limited to, hearing aids. Those skilled in the art will readily recognize how to realize different embodiments using the novel features of the present invention. Several other embodiments, applications and realizations are possible without departing from the present invention. Consequently, the embodiment described herein is not intended in an exclusive or limiting sense, and that scope of the invention is as claimed in the following claims and their equivalents.

What is claimed is:

1. A hearing aid comprising:

a microphone adapted to output a first signal based on an acoustic input:

a voice coil pickup adapted to output a second signal based on an electromagnetic input;

a signal processing circuit for processing the first signal and the second signal; and a switching circuit coupled to the microphone and to the voice coil pickup, wherein the switching circuit includes a magnetically actuated switch which energizes a voice coil circuit that includes the voice coil pickup and the signal processing circuit, and de-energizes a microphone circuit that includes the microphone and the signal processing circuit, wherein the switching circuit includes:

a first transistor having a collector coupled to the microphone, a base connected to a first node, and an emitter coupled to ground;

a second transistor having a collector coupled to a second node, a base connected to the first node, and an emitter coupled to ground;

a third transistor having a collector connected to the voice coil pickup, a base connected to the second node, and an emitter coupled to ground; and the magnetically actuated switch having a first contact connected to the first node and a second contact connected to ground.

2. The hearing aid of claim 1, wherein in a first state the first and second contacts are open, in a second state the first and second contacts are closed shorting the base of the first transistor and the base of the second transistor to ground, operatively coupling the voice coil pickup to the signal processing circuit.

3. The hearing aid of claim 1, wherein the first node is coupled to a hearing aid voltage source through a resistor, and the second node is coupled to the hearing aid voltage source through a resistor.

4. The hearing aid of claim 1, wherein the signal processing circuit is adapted to provide noise reduction and tone control.

5. The hearing aid of claim 1, wherein the magnetically actuated switch is a reed switch.

6. A hearing aid comprising:

a switching circuit;

a signal processing circuit coupled to the switching circuit;

a microphone coupled between the switching circuit and the signal processing circuit; and a voice coil pickup coupled between the switching circuit and the signal processing circuit, wherein the switching circuit includes:

a microphone switch coupled between the microphone and ground;

a second switch coupled between a voltage source node and ground;

a voice coil activating switch coupled between the voice coil pickup and ground; and a magnetically activated switch coupled between the voltage source node and ground, wherein the voltage source node is adapted to contact a hearing aid voltage source.

7. The hearing aid of claim 6, wherein the second switch is further coupled between the magnetically activated switch and the voice coil activating switch.

8. The hearing aid of claim 6, wherein each of the second switch, the microphone switch, and the voice coil activating switch includes a transistor.

9. The hearing aid of claim 6, wherein the hearing aid is an in-the-ear hearing aid.

10. The hearing aid of claim 6, wherein the signal processing circuit is adapted to provide noise reduction and tone control.

11. The hearing aid of claim 6, wherein the magnetically actuated switch is a reed switch.

12. A hearing aid system comprising a telephone handset and a hearing aid, the telephone handset having a magnet, and the hearing aid comprising:

a microphone adapted to output a first signal based on acoustic input, a voice coil pickup adapted to output a second signal based on electromagnetic input, a switching circuit having two transistor switches, the switching circuit connected to the microphone and the voice coil pickup, the switching circuit automatically transmitting the first signal with one transistor switch conducting in the absence of the magnetic field produced by the magnet and automatically transmitting the second signal with the other transistor switch conducting in the presence of the magnet;

a signal processing circuit connected to the switching circuit, the signal processing circuit receiving the signal transmitted by the switching circuit, wherein the hearing aid includes a voltage source and the switching circuit includes:

a first transistor having a collector connected to the microphone, a base connected to a first node of the voltage source, and an emitter connected to the signal processing circuit;

a second transistor having a collector connected to a second node of the voltage source, a base connected to the first node, and an emitter connected to ground;

a third transistor having a collector connected to the voice coil pickup, a base connected to the second node, and an emitter connected to the signal processing circuit; and a magnetically actuated switch having a first contact connected to the first node and a second contact connected to ground, in a default state the first and second contacts are open, in an activated state the first and second contacts are closed, the base of the first transistor and the base of the second transistor are shorted to ground and the third transistor connects the voice coil pickup to the signal processing circuit.

13. The hearing aid of claim 12, wherein the signal processing circuit is adapted to provide noise reduction and tone control.

14. The hearing aid of claim 12, wherein the magnetically actuated switch is a reed switch.

* * * * *

UNITED STATES PATENT AND TRADEMARK OFFICE

CERTIFICATE OF CORRECTION

PATENT NO. : 6,633,645 B2
DATED : October 14, 2003
INVENTOR(S) : Bren et al.

It is certified that error appears in the above-identified patent and that said Letters Patent is hereby corrected as shown below:

Title page,
Item [56], References Cited, OTHER PUBLICATIONS, delete "Jul." before "22" and insert -- Aug. --, therefor.

Signed and Sealed this

Twenty-fifth Day of May, 2004

JON W. DUDAS
*Acting Director of the United States Patent and Trademark Office*